United States Patent [19]

Hsu et al.

[11] 4,296,860

[45] Oct. 27, 1981

[54] BULK MATERIAL BOX

[75] Inventors: Fu-Tong Hsu, Bridgewater; John F. Kantz, Oxford, both of N.J.

[73] Assignee: Union Carbide Corporation, New York, N.Y.

[21] Appl. No.: 98,066

[22] Filed: Nov. 28, 1979

[51] Int. Cl.[3] ..... B65D 19/06

[52] U.S. Cl. ..... 206/386; 229/23 R

[58] Field of Search ..... 206/599, 600, 386; 229/23 C, 17 B; 220/404; 217/43 R; 52/584

[56] References Cited

U.S. PATENT DOCUMENTS

| | | | |
|---|---|---|---|
| 2,341,374 | 2/1944 | Gardner | 206/423 |
| 2,822,971 | 2/1956 | Elmendorh | 229/23 C |
| 2,989,225 | 6/1961 | Waldrop | 229/23 C |
| 3,159,326 | 12/1964 | Stonebanks | 229/23 C |
| 3,433,400 | 3/1969 | Hawkins | 220/404 |
| 3,521,420 | 7/1970 | Oliver | 52/584 |
| 3,756,498 | 9/1973 | Anderson | 229/23 C |
| 3,921,892 | 11/1975 | Macie | 229/17 B |
| 3,949,874 | 4/1976 | Heavner | 229/23 C |
| 3,972,454 | 8/1976 | Croley | 229/17 B |
| 4,013,168 | 3/1977 | Bamburg et al. | 217/43 A |

*Primary Examiner*—William T. Dixson, Jr.

*Attorney, Agent, or Firm*—Clement J. Vicari

[57] ABSTRACT

A storing and shipping box for bulk solid material is disclosed comprising: a removable top and a base member; said box formed of heavy corrugated material, having eight rectangular, vertical, integral face sections positioned around the outer periphery thereof and a plurality of downwardly-depending integral flaps inwardly folded within said outer periphery to form a portion of the base of said box and providing, when infolded, an opposed pair of enveloping panels for interlocking with opposite ends of said base member; said infolded flaps and base member providing the base and alignment of said box.

13 Claims, 8 Drawing Figures

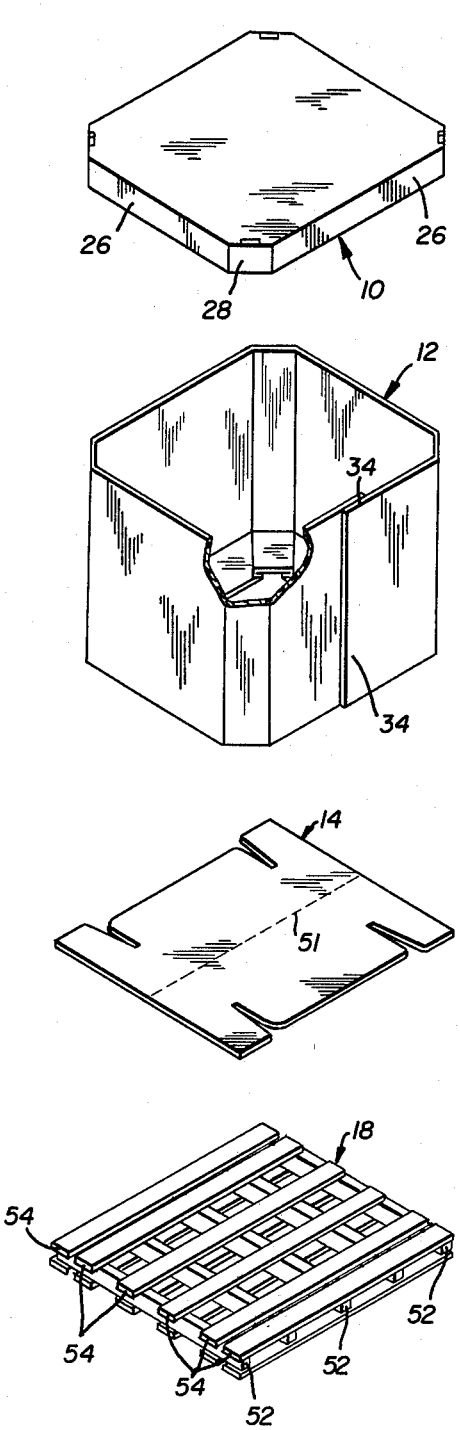
FIG. 1
FIG. 4
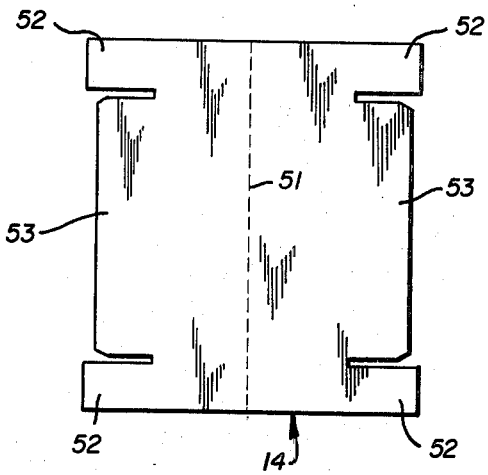
FIG. 5
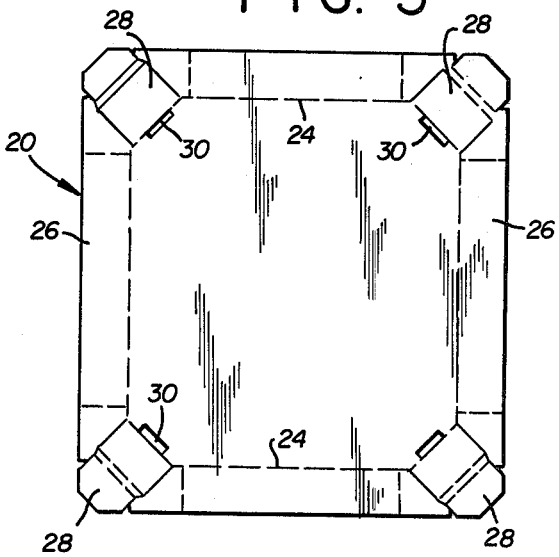

BULK MATERIAL BOX

The present invention relates to a novel bulk material box and, more particularly, to such a box and unitary storing and shipping assembly including such box and employable for storing and shipping bulk material.

Corrugated bulk boxes with supporting pallets have been employed heretofore for the storage and shipping of solid material. However, such boxes and assemblies exhibited serious inherent structural and other limitations including: limited capacity, box collapse during transit, and box collapse as a result of high humidity conditions and the like. As a result, stronger and better designed box and container assemblies of box and pallet are clearly required.

The design of such a box and container and their structural requirements for improved strength has been studied in an attempt to provide a box and container assembly resulting in improved performance capabilities required for the various operations of use including filling, inplant handling, storage and shipment between plant locations.

Accordingly, the box and container assembly satisfies the objects of the study which led to the present invention and which include: a corrugated construction maximizing bending and compressive strength of the panels of the box and the stacking (storage) capabilities of the box and container assembly; the provision of a unitary corrugated box and pallet container assembly to provide maximum supporting capabilities; by the incorporation of the flanged tube concept in the box construction; by selection of the most advantageous ratio of panel-to-perimeter dimension of the box; and by the provision of multiple corrugated wall profiles to improve resistance to crushing from the exterior.

These and other objects were realized by the provision of the box and container assembly of the present invention.

In accordance with the present invention, a storing and shipping box for bulk solid material is provided comprising: a box having a removable top and a base member; said box formed of heavy corrugated material, having eight rectangular, vertical, integral face sections positioned around the outer periphery thereof and a plurality of downwardly-depending integral flaps inwardly folded within said outer periphery to form a portion of the base of said box and providing, when infolded, an opposed pair of enveloping panels for interlocking with opposite ends of said base member; said infolded flaps and base member providing the base and alignment of said box.

The container assembly of the present invention comprises such a bulk material box joined at its base in assembly with a supporting pallet, thereby forming a unitary assembly from the structural strength standpoint and achieving all of the objects set forth hereinabove.

More specifically, the bulk box of the present invention is formed of three body members: a top, a body member and a base member, each of which is specifically formed and shaped so as to provide cooperating engagement in the formation of the box.

The three body members are each composed of sheets of heavy corrugated material. The corrugated material may be selected from a wide variety of commercially available corrugated materials having spaced, parallel liner boards of heavy paper, plastic material (such as polyethylene) or the like enclosing an internal corrugated medium positioned in an array, such as sinusoidal, and formed of paper, plastic material or composites or combinations of such paper and plastic materials and the like. The internal medium array is bonded (by gluing, thermal fusion or the like) to the interior walls of the liner boards in the manner normally employed for the formation of corrugated board material.

The three body members may be, as desired, formed of single or multiple sheets of such heavy corrugated material. It has been found preferable to form the body and base member of the box of at least double-ply material, whereas single-ply material has been found sufficient for use as the top member of the box.

Each of the three body members are formed by die cutting or the like to the shapes desired.

In the drawings

FIG. 1 is an exploded perspective view of an embodiment of the container assembly of the invention showing the top body and base members of the box and the supporting pallet;

FIG. 4 is a plan view of the base member of the embodiment of FIG. 1;

FIG. 5 is a plan view of the open top member of the box embodiment of FIG. 1;

Figure 3:
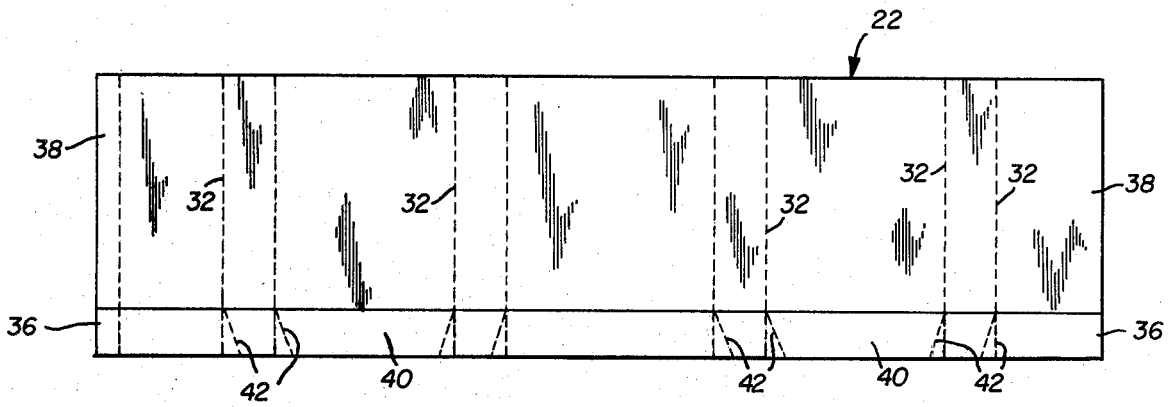
FIG. 3 is a plan view of the open box body member employed in the embodiment of FIG. 1.

Referring specifically to the embodiment of the figures of the drawings, a box is provided having a top member 10, a body member 12 and a base member 14 assembled into a completed box 16 (as shown without top in FIG. 2) and positioned on and secured to a base supporting pallet 18. The open top member 20, open body member 22 and base member 14 are respectively shown in FIGS. 5, 3, and 4 of the drawings. Each of these members is cut (as in the case of corrugated paperboard by die cutting) to the shapes there shown in the drawings with score lines formed as shown by the dotted lines in FIGS. 5, 3, and 4, respectively.

In the case of the top member, the cut, scored, open board 20 is bent along the four score lines 24 to form the top member major skirts, panels, frame or flange 26 and the tabs 28 are inwardly bent to the lock position for insertion of their ends in open slots 30, thereby locking the underlying skirts 26.

Figure 2A:
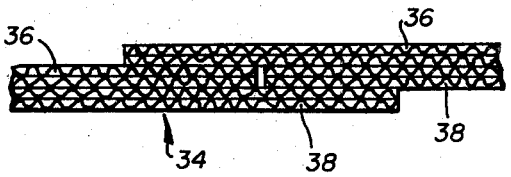
FIG. 2A is a partial horizontal sectional view of the joint of the ends of the box body member in the embodiment of FIG. 1.
Figure 2:
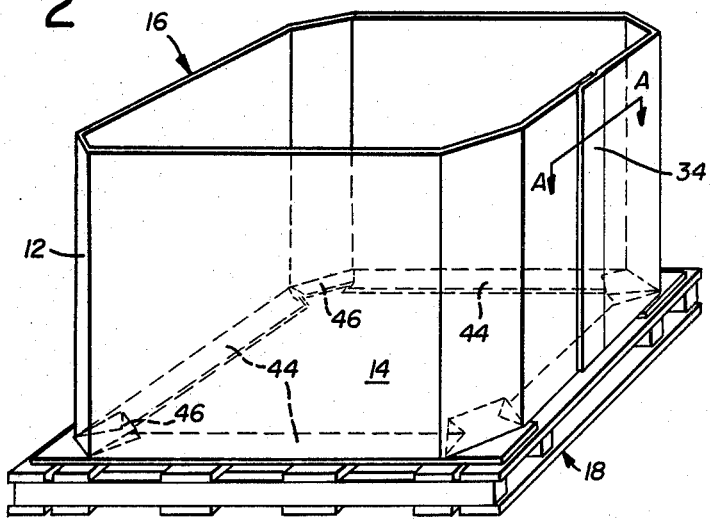
FIG. 2 is a perspective view of the container assembly of the embodiment of FIG. 1.

The open box body member 22 is folded along dotted score lines 32 to form the octagonal (eight rectangular, vertical, integral face sections) configuration shown in FIGS. 1 and 2 of the drawings. An overlapping joint area 34 is formed and is best shown in FIG. 2A of the drawings. These overlapping joints are preferably of multiple layers of corrugated board material secured as by staples, glue and the like in the event of the use of the preferred paperboard embodiment, or by heat sealing or the like in the case of the employment of thermoplastic corrugated material. In the embodiment of FIG. 2A, two external overlapping sections 36 of double corrugated material enclose the two ends 38 of the double corrugated material of the box body member. It is, of course, to be understood that the downwardly-depending integral flaps 40 may be formed of the same corrugated board as box member 12 or may be formed of a separate corrugated board joined on the inner or outer lower side of open body member 22, so as to downwardly depend therefrom.

The octagonal box body member has four pairs of opposed rectangular face sections. The largest pair forms the length dimension of the box; the intermediate pair forms the width dimension; and the two smallest pairs form the four corner sections of the box.

Figure 6:
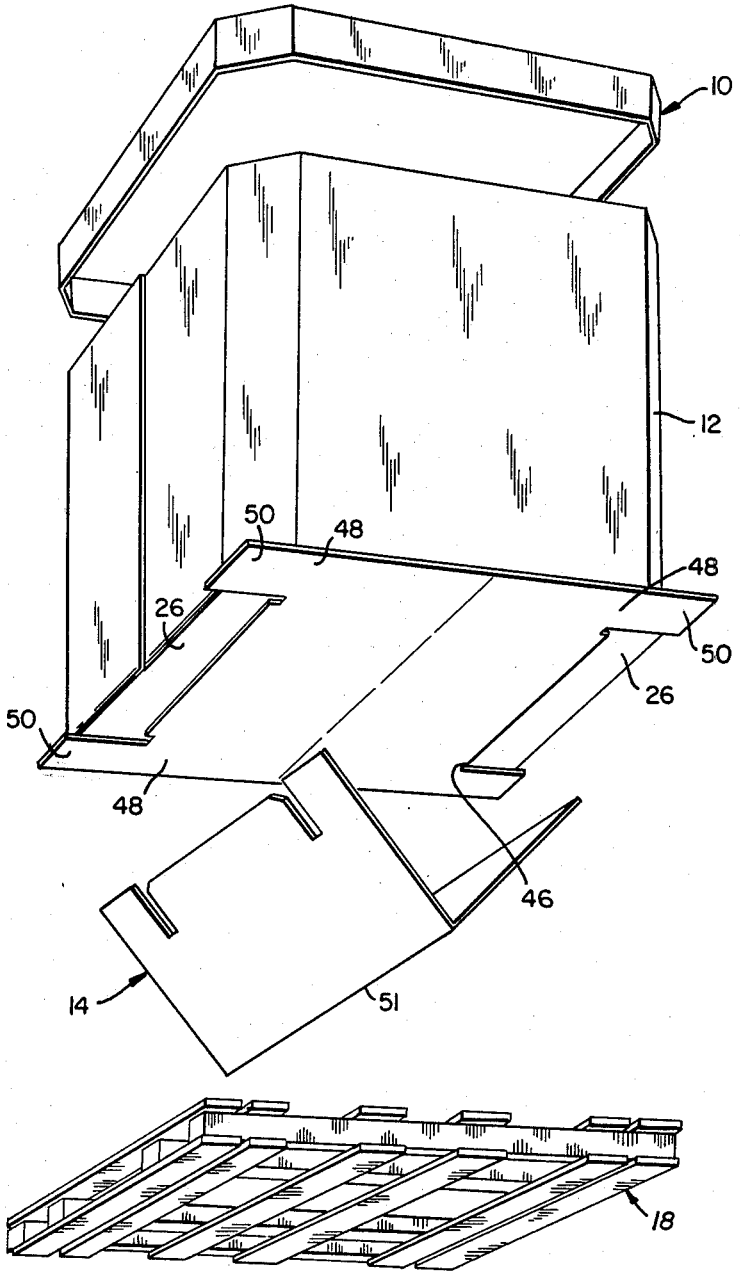
FIG. 6 is an exploded perspective view of the top member, body member, base member and a pallet of another embodiment, showing the manner of insertion and interlocking of the base member with the box body member.

The downwardly-depending integral flaps 40 of the open body member 22 are diagonally and reverse scored as at regions 42 to provide, when infolded into the box body member 12, an internal frame 44 having corner locking infolds 46 also internally infolded and lending rigidity to the box body member 12. This configuration also presents an enveloping interlocking means of retaining base member 14 when inserted in the base thereof. Upon such insertion and interlocking, as shown in FIG. 6 of the drawings, an external skirt 48 is simultaneously provided by the overhanging of base member 14 on two opposing sides of the assembled box and the provision of corner flanges 50 formed by the overhanging of corners 52 at the perimeter of the box body member 12. The insertion and interlocking of base member 14 is permitted by the central scoring at 51 of the base member to provide an ability of opposed tabs 53 (see FIG. 4) of the base member 14 to enter under the infolded panel or frame 26 of body member 12 and lock therein upon straightening of the folded base member 14.

The supporting pallets 18 are constructed of wood, plastic materials or the like and are assembled as shown in FIGS. 1, 2, 6, and 7 as having 4, 5, or 6 internal stringer elements 52 supporting oppositely positioned transverse stringer elements 54 (4, 5, or 6, as desired). The assembled box 16 is secured to the supporting pallet 18 as by stapling, gluing or nailing. In the case of stapling or nailing, external skirt 46 and corner flange 50 provide preferred locations at the exterior of the box for such staples or nails. Gluing, where desired, may take place over any or all of the areas of the base member and infolded box skirts in contact with stringers of the pallet.

In the preferred pallet employed in the container assembly of the invention, the stringers positioned near opposite ends of the pallet are grouped for columnar support of the box and the box body member corner flanges are positioned on the pallet to provide matching registry with said grouped stringers at the pallet corners.

It is also preferred that the folding scores of the box member be of a special type differing from the normal score profiles of the prior art. Such preferred folding scores are fabricated by the manufacturers of the corrugated board which is shipped by them in a lay-flat form. The folding scores at opposite ends of the lay-flat cut and joined member have, in the preferred type, a double male profile and reversed scores on opposite faces formed by semi-continuous passage of corrugated board material through a pair of roller dies having male projections on each roll. The resultant corrugated product provides a generally "U"-shaped profile at opposite ends or edges of the lay-flat product. Such score-formed edges provide the obtainment of a corner clearance enabling the product to attain a lay-flat position in spite of the inclusion of other body member structures between the outer sections.

The preferred assembly thereby presents a firmly secured unitary construction capable of supporting a load along both horizontal and vertical axes. With the top member in place, assemblies of this type can be easily vertically stacked for storage.

Figure 7:
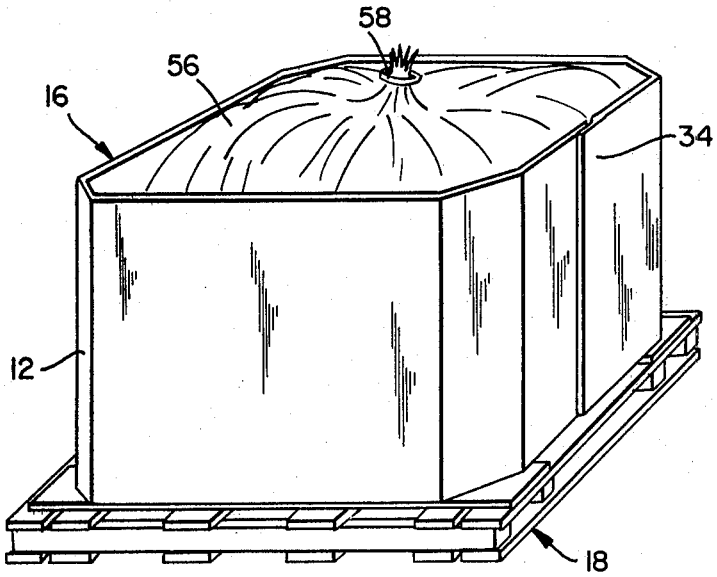
FIG. 7 is a perspective view, similar to that of FIG. 2, showing the presence of an internal, closed liner bag in the box.

It is a preferred embodiment of the present invention to employ an internal thermoplastic material liner bag 56 (as shown in FIG. 7) which, after being filled with bulk granular solid material, may be secured for closure by tying as shown at 58 in FIG. 7 of the drawings.

A number of unitary storing and shipping container assemblies of the invention have been constructed and tested. To determine and compare the compressive strength of octagonal corrugated paperboard containers designed for the shipment of bulk solid materials after exposure to both standard laboratory and high humidity conditions, a number of such containers were tested.

Twenty-five octagonal multi-ply, corrugated fiberboard containers embodying the invention were tested to compare their compressive strength.

Thirteen containers were exposed to a controlled atmosphere maintained at 50% RH. (Relative Humidity), 23° C. (73° F.) for 72 hours and twelve to a controlled atmosphere maintained at 90% RH, 32° C. (90° F.) for 72 hours before testing. Twenty-four containers were tested empty but one container—conditioned at 50% RH, 23° C. (73° F.) for 72 hours—was loaded with 1200 pounds of plastic pellets before testing.

All twenty-five containers were tested on a wooden pallet with a second pallet of like construction superimposed to simulate actual stacking conditions.

The average maximum load sustained by containers exposed to like conditions was as follows:

| | 50% RH., 23° C. | | 90% RH., 32° C. | |
|---|---|---|---|---|
| | Load (lbs.) | Deflection (inches) | Load (lbs.) | Deflection (inches) |
| Tested Empty | 19,229 | 1.80 | 11,323 | 1.47 |
| Loaded Container | 21,750 | 2.25 | — | — |

In addition, moisture content and caliper measurements were determined for the twenty-four containers after testing. Edgewise compressive strength (short column) tests were made on specimens from an untested container.

| | Moisture Content % of oven dry weight | |
|---|---|---|
| 50% RH., 23° C. | | 90% RH., 32° C. |
| 6.2 (Avg. of 12) | | 13 (Avg. of 12) |
| | Edgewise Compressive Test (lbs./inch width) | |
| | 242 (Avg. of 12) | |

The material tested consisted of 25 corrugated fiberboard bulk boxes bearing the 600# test certificate of International Paper Company, New Stanton (Pittsburgh), Pennsylvania. They were octagonal in shape, measured 47"×42"×38" high and were constructed from A-C double wall with an A-C double wall laminated liner with an 8" flange at the bottom. A die-cut and scored double wall bottom and a single box top completed the container.

Thirteen containers were exposed to a controlled atmosphere maintained at 50% RH, 23° C. (73° F.) in a partially open position to allow free access of air.

After 72 hours, twelve containers were set up and mounted on a wooden pallet with another wooden pallet superimposed to simulate stacking conditions. They were the individually subjected to a top-to-bottom compression test in accordance with American Society for Testing and Materials Test Method D-642 until maximum loads were attained. The remaining container was loaded to capacity (nominally 1500 pounds) with 1200 pounds of plastic pellets before being mounted on a wooden pallet and compression tested as described above.

Twelve additional containers were exposed to a controlled atmosphere maintained at 90% RH, 32° C. (90° F.) for 72 hours. During this conditioning period four of the containers were partially opened. The remaining eight were set up with bottoms in place but without tops. After conditioning, all containers were completely assembled, enclosed in a polyethylene bag to prevent loss of moisture and individually subjected to top-to-bottom compression tests with pallets in place as described previously. All were tested empty. The tests were performed on a 30,000 pound capacity Tinius Olsen compression machine with loads and deflection automatically recorded.

Immediately after the compression tests, samples were cut from the side walls of the test containers and used to determine moisture content in accordance with ASTM Test Method D-644. In addition, twelve samples were taken from an untested container and used to determine the edgewise compressive strength (short column) in accordance with ASTM Test Method D-2808.

Conditioned @ 50% RH., 23° C.

| Container Number | Max. Load (lbs.) | Def. at Max. Load (inch) | Moisture Content (% oven-dry weight) | Corrugated Board Caliper (inch) |
|---|---|---|---|---|
| 1 | 18,000 | 1.54 | 6 | 0.772 |
| 2 | 20,250 | 1.82 | 7 | 0.770 |
| 3 | 18,625 | 1.80 | 6 | 0.777 |
| 4 | 20,500 | 1.88 | 6 | 0.774 |
| 5 | 20,250 | 1.86 | 6 | 0.773 |
| 6 | 19,500 | 1.96 | 6 | 0.775 |
| 7 | 19,875 | 2.20 | 6 | 0.774 |
| 8 | 20,000 | 1.92 | 5 | 0.776 |
| 9 | 17,500 | 1.61 | 7 | 0.774 |
| 10 | 19,000 | 1.68 | 6 | 0.771 |
| 11 | 18,500 | 1.59 | 6 | 0.774 |
| 12 | 18,750 | 1.72 | 7 | 0.774 |
| Average | 19,229 | 1.80 | 6.2 | 0.774 |
| Std. Dev. | 975 | 0.19 | 0.58 | 0.002 |

(Container conditioned and tested as above but filled with 1,200 lbs of plastic pellets)

| Container Number | Max. Load | Deflection at Max. Load |
|---|---|---|
| 13 | 21,750 | 2.25 |

Conditioned @ 90% RH., 32° C.

| Container Number | Max. Load (lbs.) | Def. at Max. Load (inch) | Moisture Content[1] (% oven-dry) weight) | Corrugated Board Caliper[2] (inch) |
|---|---|---|---|---|
| 14 | 14,750 | 1.92 | 10 | 0.775 |
| 15 | 15,625 | 1.74 | 10 | 0.777 |
| 16 | 14,875 | 1.72 | 10 | 0.773 |
| 17 | 14,750 | 1.96 | 11 | 0.777 |
| 18 | 10,875 | 1.34 | 15 | 0.759 |
| 19 | 10,625 | 1.43 | 14 | 0.762 |
| 20 | 10,375 | 1.34 | 13 | 0.768 |
| 21 | 11,250 | 1.40 | 13 | 0.764 |
| 22 | 7,375 | 1.12 | 17 | 0.761 |
| 23 | 8,000 | 1.00 | 16 | 0.764 |
| 24 | 8,500 | 1.28 | 16 | 0.769 |
| 25 | 8,875 | 1.40 | 13 | 0.760 |
| Average | 11,323 | 1.47 | 13 | 0.767 |
| Std. Dev. | 2,966 | 0.30 | 2.5 | 0.007 |

[1]The first four containers were conditioned, partially opened. The remainder were conditioned, set up without tops.
[2]After reconditioning at 50% RH, 23° C.

Edgewise Compressive Test (Short Column)
Sample size 1.25 inches high (flute direction) by 2.00 inches wide.

| Sample No. | Max. Load (lbs) |
|---|---|
| 1 | 425 |
| 2 | 520 |
| 3 | 420 |
| 4 | 505 |
| 5 | 480 |
| 6 | 485 |
| 7 | 360 |
| 8 | 520 |
| 9 | 490 |
| 10 | 545 |
| 11 | 560 |
| 12 | 480 |

Average Max. Load: 483 lbs.
Average maximum load/unit width: 242 lbs.
S.D.: 57

It has been concluded from overall analysis, including consideration of the above test data, that the box and container assembly of the present invention possesses compressive performance superior to that of the prior art, regardless of the specific humidity conditions of use.

After testing which yielded the data set forth above, some changes were made as to dimensions and ply construction of the box and the supporting pallet to obtain a most preferred embodiment, i.e., that shown in FIGS. 1 through 7 of the drawings. In that embodiment, the four corner panels of the octagonal box were chosen to have widths of 10 inches, two opposed sides of the four side faces of the box were chosen to have a width of 27.5 inches, and the other two opposed side faces were chosen to have a width of 32 inches, and the height of the box was chosen at 38 inches with a depending flange of an additional 8 inches to provide a total unfolded height of 46 inches. Such a box was secured to a supporting pallet having five internal stringers and opposed pairs of six external stringers, as shown in FIG. 1 of the drawings. The pallet had over-all dimensions of 48 inches by 43 inches by 5 inches in height. The interior of the box was lined with a high density polyethylene liner bag capable of "top-tying" and containing 1500 pounds of granular high density polyethylene material (beads). This container assembly was found to possess exceptionally high strength against impact and compressive loading and to enable considerable bending without rupture in response to applied forces, even under conditions of high humidity.

It is, of course, to be understood that the bulk solid material contained in the box of the present invention may be in forms other than beads or pellets (such as powders or the like).

What is claimed is:

1. A storing and shipping box for bulk solid material comprising: a removable top, a body member, and a base member; said box formed of heavy corrugated material, having eight rectangular, vertical, integral face sections positioned around the outer periphery thereof and a plurality of downwardly-depending integral flaps inwardly folded within said outer periphery to form a portion of the base of said box and providing, when infolded, two opposing pairs of infolded flaps, the first of said opposed pairs having panels defining a rectangular configuration and the second of said opposed pairs having panels defining a trapezoidal configuration, said base member having opposite ends which interlock with each of the panels of said first opposed pair; said infolded flaps and base member providing the base and alignment of said box.

2. The storing and shipping box in accordance with claim 1, wherein said corrugated material is paper.

3. The storing and shipping box in accordance with claim 1, wherein said heavy corrugated material comprises a multiplicity of plies of single corrugated material.

4. The storing and shipping box in accordance with claim 1, wherein a liner bag of plastic material is positioned within said box.

5. The storing and shipping box in accordance with claim 4, wherein said liner bag is formed of high density polyethylene resin film.

6. A unitary storing and shipping container assembly for bulk solid material comprising: a box having a removable top, a body member, and a base member, and a rigid pallet secured to and supporting said box at its base; said box formed of heavy corrugated material, having eight rectangular, vertical, integral face sections positioned around the outer periphery thereof and a plurality of downwardly-depending integral flaps inwardly folded within said outer periphery to form a portion of the base of said box and providing, when infolded, two opposing pairs of infolded flaps, the first of said opposed pairs having panels defining a rectangular configuration and the second of said opposed pairs having panels defining a trapezoidal configuration, said base member having opposite ends which interlock with each of the panels of said first opposed pair; said infolded flaps and base member providing the base and alignment of said box to said supporting pallet and the resultant unitary container assembly.

7. The unitary storing and shipping container in accordance with claim 6, wherein said corrugated material is paper.

8. The unitary storing and shipping container in accordance with claim 6, wherein said heavy corrugated board comprises a multiplicity of plies of single corrugated material.

9. The unitary storing and shipping container in accordance with claim 6, wherein a liner bag of plastic material is positioned within said box.

10. The unitary storing and shipping container in accordance with claim 9, wherein said liner bag is formed of high density polyethylene resin film.

11. The unitary storing and shipping container in accordance with claim 6 wherein the stringers of said pallet positioned near opposite ends of said pallet are grouped for columnar support of said box and the box body member corner flanges are positioned on said pallet to provide matching registry with said grouped stringers at said pallet corners.

12. A storing and shipping box according to claims 1 or 6 wherein said base member includes a central score line.

13. A storing and shipping box according to claim 12 wherein said base member further includes an external skirt provided by the overhanging of said base member on two opposing sides of said assembly box.

* * * * *